US008714387B2

(12) United States Patent
Davidson

(10) Patent No.: US 8,714,387 B2
(45) Date of Patent: May 6, 2014

(54) TRANSPORT PACKAGE

(76) Inventor: Roderick Iain Davidson, Petersfield (GB)

( * ) Notice: Subject to any disclaimer, the term of this patent is extended or adjusted under 35 U.S.C. 154(b) by 744 days.

(21) Appl. No.: 12/600,080

(22) PCT Filed: May 30, 2008

(86) PCT No.: PCT/GB2008/001850

§ 371 (c)(1),
(2), (4) Date: Feb. 17, 2010

(87) PCT Pub. No.: WO2008/146010

PCT Pub. Date: Dec. 4, 2008

(65) Prior Publication Data

US 2010/0308038 A1 Dec. 9, 2010

(30) Foreign Application Priority Data

Jun. 1, 2007 (GB) ..... 0710464.9
Nov. 14, 2007 (GB) ..... 0722344.9
Dec. 14, 2007 (GB) ..... 0724396.7

(51) Int. Cl.
*B65D 53/00* (2006.01)
*B65D 25/14* (2006.01)

(52) U.S. Cl.
USPC ..... 220/4.21; 220/4.23; 220/4.24; 220/795; 220/849

(58) Field of Classification Search
USPC ..... 220/4.21, 4.24, 62.11; 206/204
See application file for complete search history.

(56) References Cited

U.S. PATENT DOCUMENTS

| | | | | |
|---|---|---|---|---|
| 3,834,606 | A * | 9/1974 | Andersson | 229/406 |
| 4,853,266 | A | 8/1989 | Cullen | |
| 4,927,010 | A * | 5/1990 | Kannankeril | 206/204 |
| 4,964,509 | A * | 10/1990 | Insley et al. | 206/204 |
| 4,969,750 | A | 11/1990 | Russo | |
| 5,176,930 | A * | 1/1993 | Kannankeril et al. | 426/124 |
| 5,239,839 | A * | 8/1993 | James | 62/434 |
| 6,530,472 | B2 * | 3/2003 | Hacikyan | 206/204 |
| 6,662,941 | B2 * | 12/2003 | Lowry et al. | 206/204 |
| 6,740,145 | B2 * | 5/2004 | Boroson et al. | 96/108 |
| 2003/0178328 | A1 * | 9/2003 | Williamson | 206/204 |
| 2004/0163973 | A1 * | 8/2004 | Longo | 206/204 |
| 2005/0082298 | A1 * | 4/2005 | Gano et al. | 220/592.01 |
| 2005/0247708 | A1 * | 11/2005 | Golden | 220/4.21 |

FOREIGN PATENT DOCUMENTS

| | | |
|---|---|---|
| FR | EP 1510470 | 3/2005 |
| WO | WO 02/45647 | 6/2002 |

* cited by examiner

*Primary Examiner* — Mickey Yu
*Assistant Examiner* — Niki Eloshway
(74) *Attorney, Agent, or Firm* — Jennifer Meredith, Esq.; Meredith & Keyhani, PLLC

(57) ABSTRACT

A package has two complementary casing-parts (102,103) having a central, outwards-extending depression (106,107) for accommodating opposite sides of a container C. One of the casing-parts (102) is lined with a super-absorbent material lining (108). The depression in each casing-part is surrounded by a respective surround (109, 110). The surrounds have margins (112,114), which are stepped in the opposite direction from the depressions, i.e. inwards of the closed condition of the package. With the interposition of the lining (108), the margins abut when the casing-parts are closed together.

39 Claims, 7 Drawing Sheets

TRANSPORT PACKAGE

The object of the present invention is to provide an improved transport package for a leak-risk container, that is to say a container for which there is a risk of accidental leakage either from incomplete closure or through accidental damage.

According to the invention there is provided a transport package for a leak-risk liquid container, the transport package comprising:

- a casing for enclosing the container and formed of a complementary pair of casing-parts of impermeable material, arrangeable opposite each other for closure of the casing,
  - one of the casing-parts having:
    - a container-receiving depression extending in a direction outwards of the casing when closed and
    - a rim around the depression, the rim adjoining the depression or being set away from it and extending in the outwards direction or in the opposite, inwards direction, and
  - the other of the casing-parts having:
    - a central region opposite the depression in the other casing-part when the casing is closed and
    - a rim around the central region, the rim extending inwards of the casing when closed or outwards,
- the directions in which the rims extend being such that when the container is closed the rims fit the one within the other, and
- a super-absorbent material lining on at least one of the casing-parts, the lining extending from one or both of the depression and the central region as far as and between the rims when the container is closed, with negligible clearance at the rims either between the linings where both casing-parts are lined or between the lining of the lined one of the casing-parts and the other casing-part where one only is lined, the arrangement being such that liquid accidentally released from an encased container is absorbed by the super-absorbent material centrally of the rims and does not penetrate appreciably between the rims, initial liquid (if any) reaching the said negligible clearance and swelling the super-absorbent material there, with further permeation of liquid being blocked by the swelling providing "gel blocking".

Whilst the central region can be plain, with its casing-part acting as a lid to the other casing part, normally the central region will have its own depression, i.e. with both casing-parts having container receiving depressions opposite each other for opposite portions of the same container. These may be for a single container, or a plurality of containers. For the latter, the depressions may all be for a single size of container or they may be sized to receive a plurality of different sizes of container.

Where both casing-parts have depression(s), they may be larger in one casing-part than the other. Normally, the rim having the larger depression will extend in the same direction—outwards of the closed casing—as the depression.

The or each depression may be a regular shape and the rim in its casing-part may extend directly from its edge. However, normally, a surround will be provided around the depression between the latter and the rim.

Preferably, the surround and the central region, where only one casing-part has a depression, or the surrounds, where both casing-parts have depressions, have margins that abut each other in the same manner as the rims, namely with negligible clearance, whereas the central portions of the lands are stepped away from each other, to allow space for the super-absorbent to expand into in event of liquid release. The margins provided pinch points at which gel blocking can occur against liquid permeation outwards of the depressions.

The surrounds can have inner lands stepped away from each other, the arrangement allowing space for the super-absorbent lining to expand into in event of liquid release on container breaking, the margins providing pinch points at which gel blocking can occur against liquid permeation outwards of the margins.

Preferably, the or each depression has at least one narrow region having prominent features arranged to locate the container within the depression and at least one wide region providing clearance from the container allowing space for the super-absorbent lining to expand into in event of liquid release on container breaking.

Preferably, the or each depression is sized to receive a container of a standard size and the package is sized to provide additional space within the closed package at least as large as the liquid contents space of the container(s), whereby the super-absorbent lining can absorb this volume of liquid.

Preferably, the additional space is at least half as large again as the liquid contents space.

In addition to the expansion space between the surrounds—or between the one surround and the central region—the depression(s) preferably have clearance around the container(s) with prominent features arranged to locate the container within the depression. This clearance allows further super-absorbent expansion space. In contrast, and as just mentioned, the abutted margins provide initial gel blocking to passage of liquid liable to experience further gel blocking between the rims. Gel blocking action is particularly marked at corners between margins and rims, where the corners stiffen the casing-parts against deformation, which latter could allow expansion of the super-absorbent material.

Preferably the space within the closed package, between the container or containers (if more than one) and the casing-parts is at least as large as the liquid contents space of the container(s), whereby the super-absorbent material can absorb the full liquid volume. Indeed it is preferred to allow ample excess of absorbency, whereby absorption occurs locally to the leak from the container. Indeed we have noted that local expansion can block a leak from spreading from the leak point. Normally this will be a poorly fit phial lid. In this case we have even noted that super-absorbent material expansion can seal the leak by urging the phial and its lid against the opposite casing-part, even when the latter is unlined and to an extent that the unleaked remains of a contained sample can still be used.

Preferably, the package is provided with further features to ensure that it is leak-tight. The inner of the rims can have a lip that turns out and has a return in the direction of the inner rim. The outer rim also has a lip, sized to fit tightly between the inner rim and its return. Thus another gel blocking corner is provided between the rims and the lips.

To secure the packaging against unintentional opening, the return in the direction of the inner rim can be angled towards the inner rim, whereby it overhangs the edge of the other lip and captivates it.

The two casing-parts can be formed separately or have a living hinge and be configured as a clam shell pair, providing security against opening along the hinged edge. The opposite edge can be provided with a pair of inter-locking tabs.

It is envisaged that the lining can be a mat of super-absorbent material and binding fibres. However, preferably the lining has a surface layer of permeable material and with the super-absorbent material then captive between the surface permeable layer and the lined casing-part. The surface layer assists with gel blocking.

The lining will normally be applied to the or each casing-part in lamination rollers, particularly where the casing-parts are formed by thermoforming in a subsequent operation. Alternatively, the lining can be laminated to the casing-part in the thermoforming press. Again, if the casing-part is injection moulded, the lining can be laminated in after moulding, or indeed possibly the lining can be included in the injection mould with the plastics material injected against it.

Preferably the lining is comprised of two layers of non-woven fabric, having the super-absorbent material sandwiched between. The layers can be loosely adhered together for cohesion of the lining during lamination. Alternatively to non-woven fabric, one or other of the layers can be of film, perforated in the case of the outer layer. To aid in adhering of the inner layer to the casing-part, the latter and/or the lining can be provided with a thin coating of low melting point plastics material to act as an adhesive. Again, the inner of the two layers is plastics material, such as polyethylene, having a lower melting point than that of the outer of the layers, such as polypropylene. It is conceivable that the inner layer of non-woven fabric could be replaced by a thin layer of low melting point plastics material such as polyethylene.

Preferably, a disinfectant, biocidal, antibacterial and/or antiviral agent is blended in with the super absorbent material.

In one embodiment, the package can include at least one envelope of a thermal controlling agent in contact with a respective the casing-part for temperature control of the or each leak-risk container. The thermal controlling agent can be a eutectic brine material. Preferably, the or each phase change envelope includes a thermo-forming complementary to its casing-part and engaging it at its rim. The thermo-forming can have a second thermo-forming welded to it to envelope the thermal controlling agent. The transport package can include a foam material receptacle for the casing and the eutectic material envelopes. Alternatively, the or each envelope comprises a thermoforming having a lip welded to a complementary lip of the or each casing-part.

To help understanding of the invention, a specific embodiment thereof will now be described by way of example and with reference to the accompanying drawings, in which.

Figure 1:
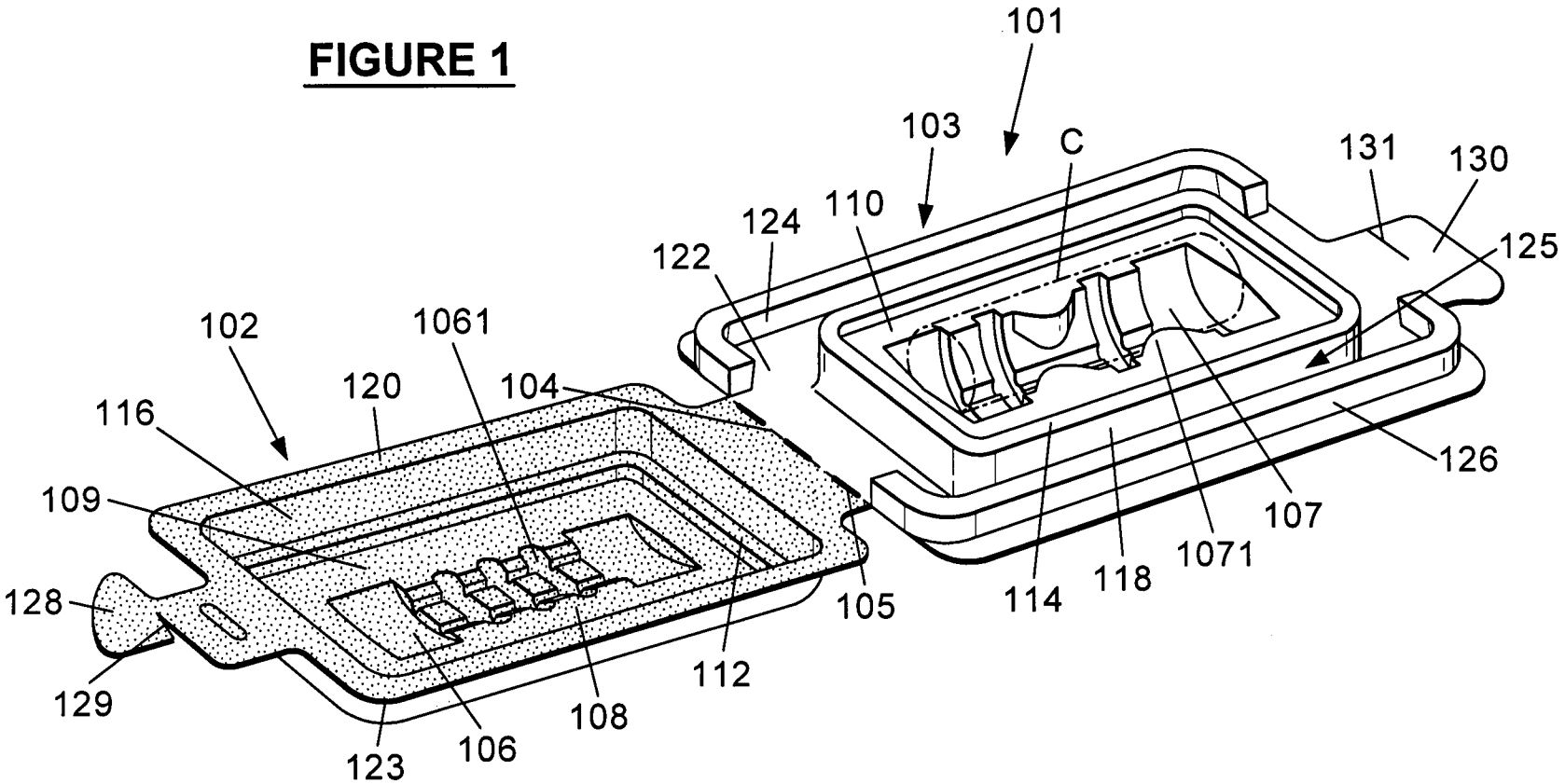
FIG. 1 is a perspective view of an open transport package in accordance with the invention.
Figure 2:
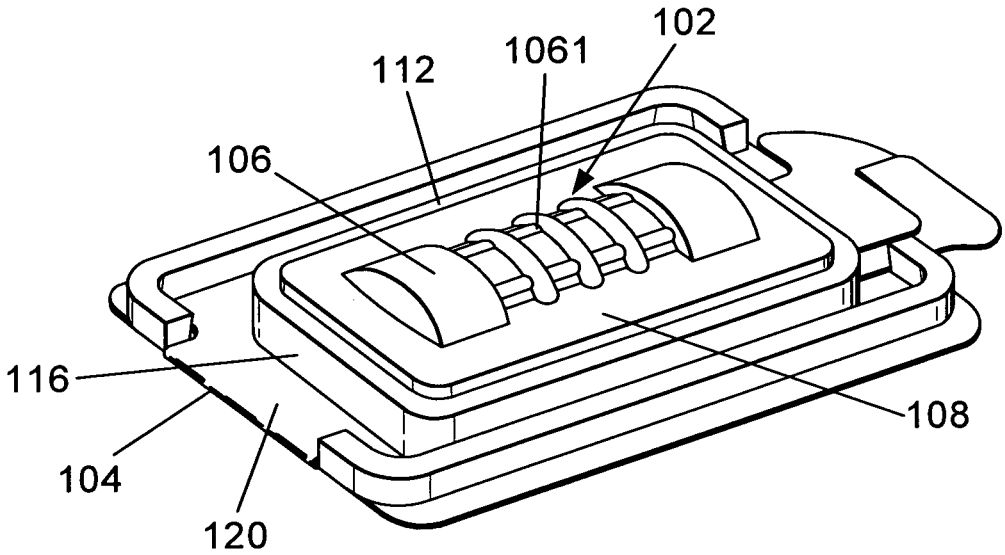
FIG. 2 is a similar view of the transport package closed.
Figure 3:
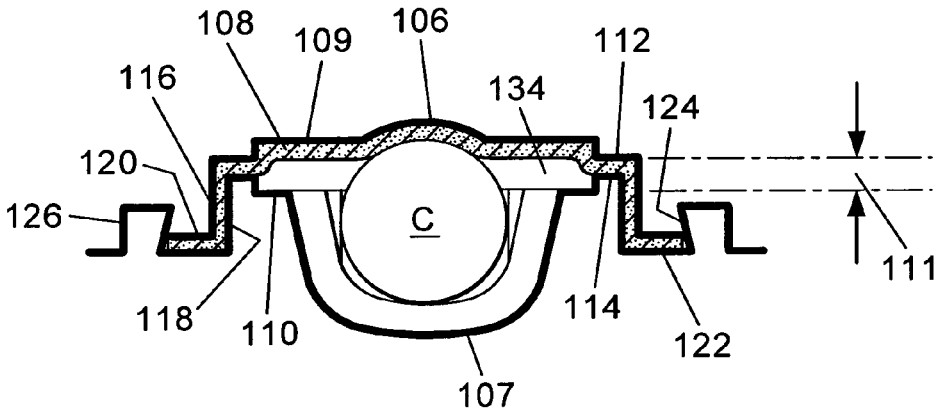
FIG. 3 is a cross-sectional view of the transport package showing an encased container.

Referring to FIGS. 1 to 4 of the drawings, a transport package 101 is formed of 1 mm thick polypropylene.

The package has two complementary casing-parts 102, 103, joined together by a living hinge 104, at which the material of the casing-parts has been partially cut through in three positions 105. The casing-parts in each have a central, outwards-extending depression 106,107 for accommodating opposite sides of a container C and are complementary in having inter-engaging formations in particular the margins, rims and lips described below. With the container C in the central depression of one of the casing-parts, the other can be hinged to lie over the container and the other casing part. Then with the mentioned formations inter-engaged, the container is encased. In this closed state, the transport package has a closed size of 160 mm by 110 mm. The structure so far described, including the relatively thick material of the package, provides normal protection for container, which may be a medical phial containing a liquid specimen, against fracture. To assure location of the container, the depressions are provided with stiffening and container location formations 1061,1071.

One of the casing-parts 102 is lined with a super-absorbent material lining 108. However, before describing it and its operation in detail, it is convenient to describe the structure of the casing-parts.

The depression in each casing-part is surrounded by a respective surround 109,110. These are separated by a gap 111, when the package is closed. The surrounds have margins 112,114, which are stepped in the opposite direction from the depressions, i.e. inwards of the closed condition of the package. With the interposition of the lining 108, the margins abut when the casing-parts are closed together.

Extending transversely away from the surrounds, at the outer edges of the margins are rims 116,118. These fit the one within the other when the casing-parts are closed. Lips 120, 122 extend away from the rims parallel to the surrounds and their margins. These also abut when the casing-parts are closed. The lips are the limit of the complementary nature of the casing-parts. One of the latter, whose depression 106 is shallower than the other 107, is cropped off at the edge 123 of its lip 120. The other has a return 124 extending back in the direction of its rim 118, slightly over-hanging its lip 122, whereby, once the casing-parts are closed the lip 120 is captivated in the groove 125 formed by the rim 118 and the return 124. Thus the two casing-parts can be separated again only forcibly and hence retain encased the container under normal transport conditions. The return 124 is continued by a lazy Z formation 126 which acts to stiffen the edge of the package.

It will be noted that the changes in angle of the skin of the package, namely at the corner between the margins and the rims and the corner between the rims and the lips, provide two places where not only do the casing-parts fit snugly together but they are restrained by the stiffening effect of the corners from moving apart, so long as the casing-parts remain closed, with the lip 120 captive in the bottom of the groove 125.

To further ensure that the package remains closed during transport, the ends of the casing-parts opposite from the living hinge are provided with respective tabs 128, 130, each provided with a slit 129, 131. These are inter-engageable by flexing past each other.

As mentioned above, the casing-part 102 carries a lining 108, comprised of two layers of non-woven polypropylene fabric, enclosing super-absorbent material which will normally be in powder form. This extends to the cropped edge 123 of the casing-part. Thus it extends around the corners between the margins & the rims and the rims & the lips. At the corners, there is no space for the lining to expand as is its nature in the presence of moisture. If the container C has accidentally fractured—due to abnormal stress on the package and the container—and liquid is free inside the package and is absorbed by the super-absorbent centrally of the rims; minimal expansion that can take place does so at the corners—or at least the corner between the margins and the rims—then acts to block the further passage of the moisture as might otherwise occur by capillary action. The provision of the corner between the rims and the lips provides a further safety factor in this respect.

Figure 4:
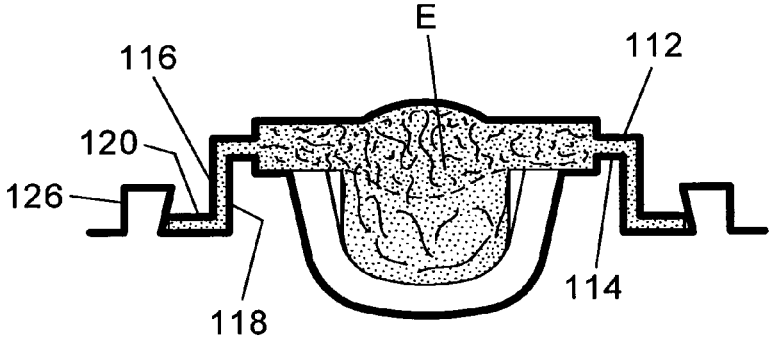
FIG. 4 is a similar view of the package after accidental fracture of the encased container.
Figure 5:
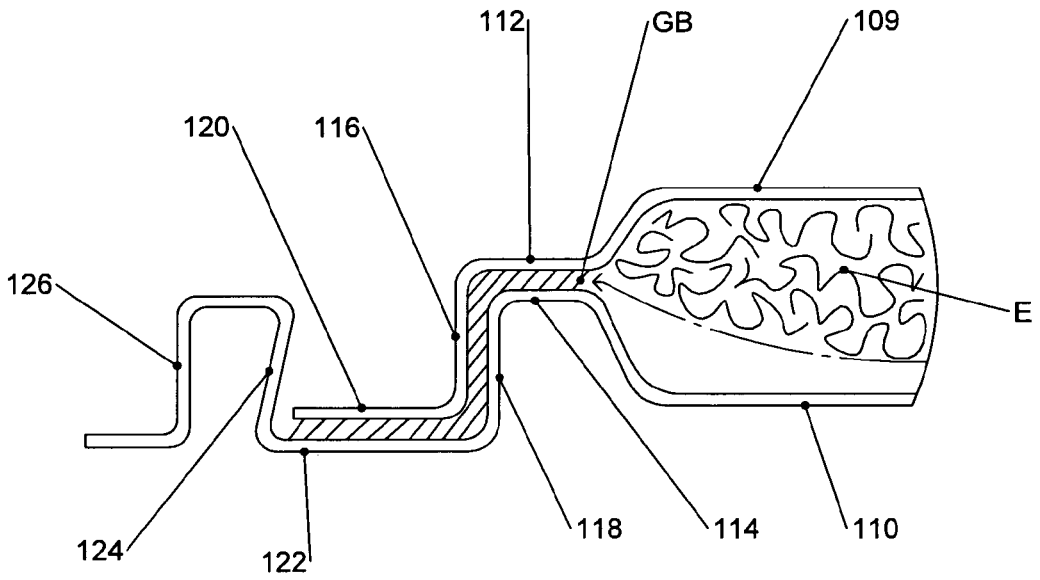
FIG. 5 is a scrap view of the left hand side of FIG. 104 in more detail.

The gap 111 between the surrounds around the depressions and a space 134 between the container and the casing parts at the depression, together provided volume within the package. In event of fracture of the container, the volume can take up the liquid contents and more importantly, the super-absorbent material can expand E into the volume, as shown in FIG. 4, to take up the liquid. Thus there is no tendency due to excess liquid unabsorbed for the super-absorbent material to either burst open the casing or to forceably separate the rims; and hence allow leakage. Indeed, it is expected that the situation will normally be as shown in FIG. 5, namely that the two casing-parts are held together sufficiently tightly and that there is sufficient expansion volume that in turn gel blocking GB occurs at the inner edges of the margins 112,114. These margins have a further function in that should the package be crushed—the most likely form of container bursting damage—the margins are pressed firmly together, enhancing the mentioned gel blocking.

Figure 6:
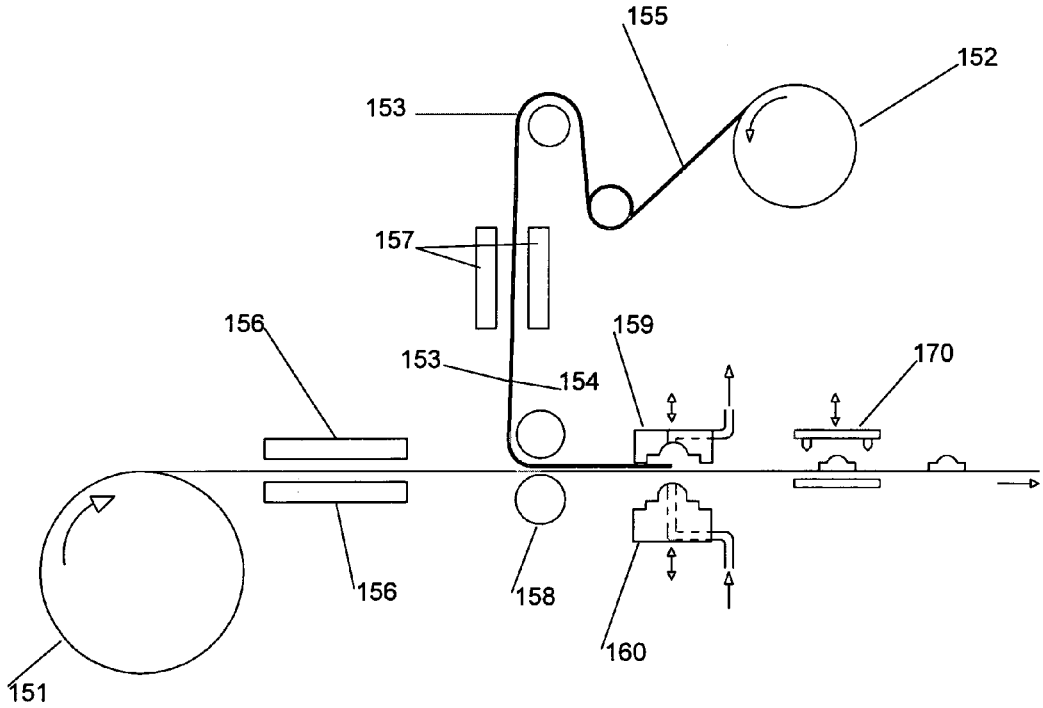
FIG. 6 is a diagrammatic view of production of the container.

Turning now to FIG. 6, manufacture of the package will be described. The starting materials are:

- a roll 151 of 1 mm thick thermoforming grade polypropylene with a deposit 152 of polyethylene on one side to act as adhesive and
- a roll 152 of super-absorbent material laminate held coherent with a small addition of adhesive and comprising outer layers 153,154 of non-woven polypropylene scrim and a filling 155 of super-absorbent powder. Typically the non-woven layers can be of 40 gms/sq m material for the outer layer 154 remaining exposed in the casing and 20 gms/sq m for the other layer 153 with the super-absorbent powder being used at the rate of 60 gms/sq m. Additionally a 15 gms/sq m polyethylene layer 153' can be provided as an adhesive layer.

Webs drawn from the rolls pass between respective opposed, infrared heaters 156,157. The polypropylene web travels horizontal and the super absorbent web vertically to the nip of a pair of combining rollers 158, where the lower scrim layer is pressed into the hot polyethylene. The combined webs pass immediately between a pair of vacuum and pressure forming dies 159,160. The web is formed to shape, to provide each casing-part with its features. The super-absorbent liner is firmly combined with and adhered to the casing-parts to be lined. The formed web is then passed to a cutting station 170, where the surplus web material is cropped from the now formed packages.

Figure 7:
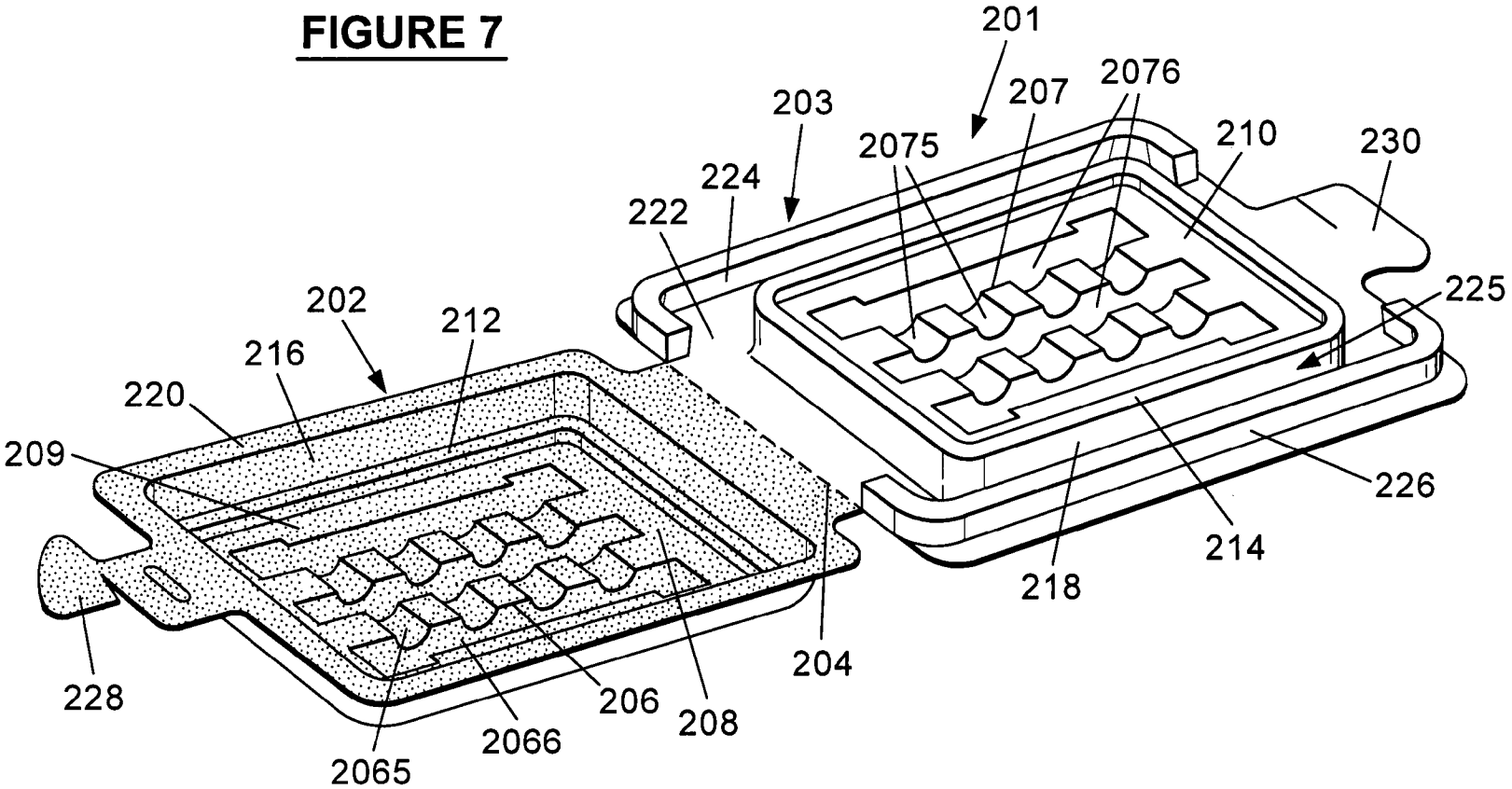
FIG. 7 is a view similar to FIG. 1 of a second transport package of the invention.
Figure 8:
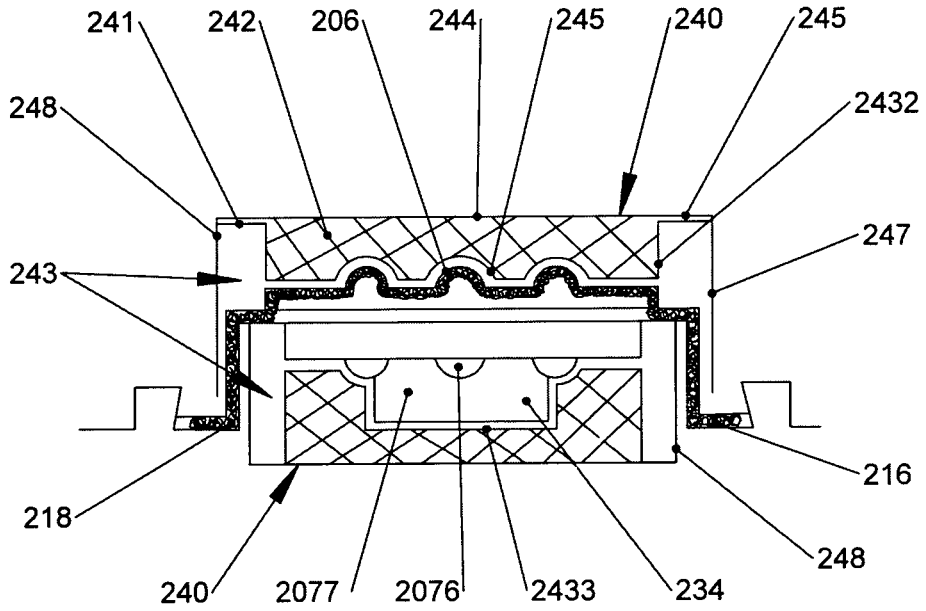
FIG. 8 is a view similar to FIG. 3 of the second transport package.

Turning on to FIGS. 7 & 8, a second package in accordance with the invention will now be described. In common with the package described with reference to FIGS. 1 to 5, it has the following components performing the same function, their reference numerals being 200 numbers in concordance with the 100 numbers of the first package:

two complementary casing-parts 202,203
living hinge 204
outwards-extending depressions 206,207
super-absorbent material lining 208
depression surrounds 209,210
margins 212,214
rims 216,218
lips 220,222
return 224
groove 225
lazy Z formation 226
tabs 228, 230
space 234

This embodiment has two main differences from the first:

1. Arrangement of the depressions;
2. Provision of cold packs.

The depressions 206,207 are arranged to receive not only a plurality of containers but also different sizes of these. Thus the depression 207 has four deep depression areas 2075 for short large diameter containers and three shallow depression areas 2076 for longer smaller diameter containers—the containers as such not being shown. The depression 206 has three depression areas 2066 for six of the longer small diameter containers aligned in pairs. However, the depression areas 2076 & 2066 are of equal depth. The depression 206 also has shallow depression areas 2065 corresponding to the areas 2075, which are deeper. Thus large diameter containers are primarily contained in the depression 207 and whilst small diameter ones are held half in one depression and half in the other. The areas 2065,2075 and the areas 2066,2076 are set at right angles to each other and cross, so that both types of container cannot be accommodated at the same time. However, the arrangement does allow four of one type of container or six of the other type to be accommodated and transported at one time.

Also shown in FIG. 8 are "cold packs" 240. These are thermoformed envelopes 241 containing eutectic brine material 242, that is a mixture of a brine typically of calcium chloride, mixed with glycol and an organic oil such as rape seed oil. Such eutectic brines are known to be able to be formulated to have a eutectic, freezing or phase change point at a desired point a few degrees above zero centigrade for instance. Thus until all the material is melted, it remains at its temperature and by its large thermal mass controls the temperature of whatever is in contract with it. The envelope is of first and second thermoformings 243,244, sealed together 245 to retain the eutectic material. Whilst formings 244 are in the nature of lids, the formings 243 are complementary to the casing parts 202,203. That is to say forming 2432 has a central region 246 complementary to the depression 206 and rim 247 complementary to the rim 216. Thus the temperature control pack can be mated to the casing 202 so that the effect of the temperature control agent 242 is to keep the contents of the package at the eutectic temperature. The lid 244 is sealed to the forming 2432 at the bottom of a channel 248 formed between its central region 246 and its rim 247.

The forming 2433 is essentially similar, with its central region being complementary to the depression 207, a narrower channel 248 and its rim 247 engaging inside the rim 218.

To further assure the function of the temperature control agent, the combination of the casing parts 202,203, their contents and the temperature control packs 240 can be inserted in a recessed, insulation foam block in an insulated carrying box—neither shown in FIG. 8.

Figure 9:
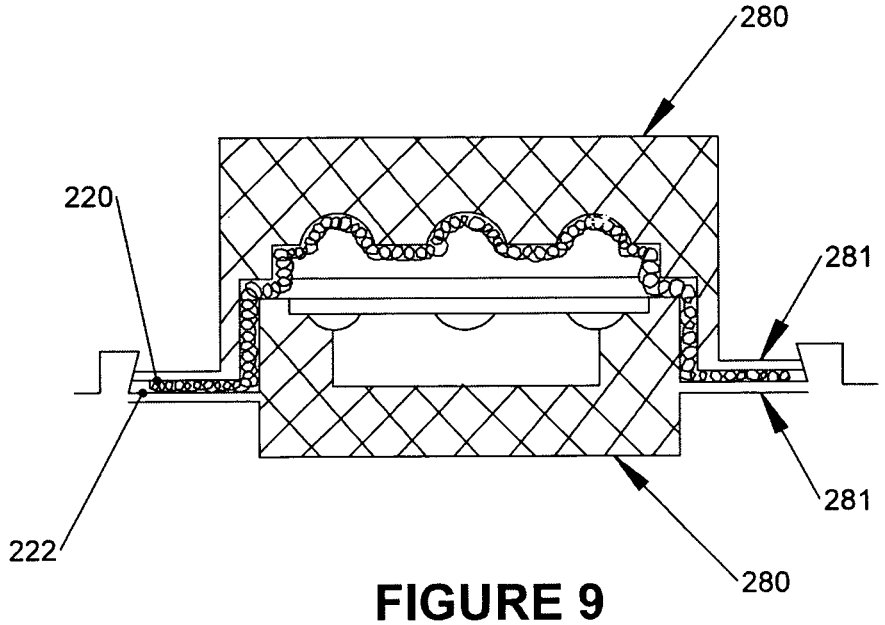
FIG. 9 is a view similar to FIG. 8 showing a variant of the second package.

Turning onto FIG. 9, whilst the arrangement just described has the advantage that the temperature control packs can be fitted at will and indeed re-used, the arrangement of this Figure has the envelope thermoformings 280 heated sealed at rims 281 to the lips 220,222, so eutectic brine material is enveloped by the formings and the casing parts. This arrangement cannot be fitted at will, but does provide more intimate contact of the brine material with the casing-parts.

The invention is not intended to be restricted to the details of the above described embodiments. For instance, punctured film is envisaged to be suitable in place of non-woven scrim in the super absorbent lining. The scrim is preferred for its wicking ability. However provided the film is sufficiently hydrophilic to allow the liquid to pass through punctures distributed across its surface (whilst still retaining the super-absorbent material), the super-absorbent material itself provides adequate wicking for the liquid to permeate throughout the material except where gel blocking, occurrence of gel blocking in event of a ruptured container being an important feature of the invention in such event Again it is possible to add wicking fibre to the super-absorbent, to promote capillary transfer of the liquid through the super-absorbent. It should be noted however, that polypropylene scrim is mildly hydrophobic, which is of cosmetic advantage in causing expanded super-absorbent material within the scrim to feel dry to touch.

Further, it can be envisaged that where the super-absorbent is laid in a sufficient coherent matt on the layer of non-woven or punctured material which is innermost in the closed package, the other, outermost layer may be dispensed with and the coherent matt bonded, for instance by the layer of polyethylene, directly onto the polypropylene. Whilst we prefer to use powdered super-absorbent material, because it has a greater absorbency; we envisage that the material could be used in fibrous form. In this case and indeed in the case of use of fibres to promote wicking through the super-absorbent, care needs to be taken to ensure that the fibres do not provide a route for wicking of the liquid past gel blocks at the rims.

Whilst in the preferred embodiments above, the two casing-parts are provided with container accommodating depressions, where for instance the containers are small phials, one only of the casing-parts, in effect provided as a tray, can be provided with depressions, with the other being provided with a plain central region and be in effect a lid over the tray.

Again both casing-parts can be lined with a super-absorbent containing material. However, we prefer to line only one and form the other of transparent material, which enables visual inspection for leaks prior to opening of the package on its receipt, particularly where powdered dye is provided in the lining, which spreads colouring the entire damp area of the lining in event of container leakage.

As described above, the material of the casing-parts has been given as polypropylene. However, other materials such as polyethylene terephthalate—PET—can be used. For reasons of structural integrity, the casing-parts are unlikely to be of material less that 0.35 mm thick.

The invention claimed is:

1. A transport package for a leak-risk liquid container, the transport package comprising:

a casing for enclosing the container and formed of a complementary pair of casing-parts of impermeable material, arrangeable opposite each other for closure of the casing, one of the casing-parts having:

a container-receiving depression extending in a direction outwards of the casing when closed and a rim around the depression, the rim adjoining the depression or being set away from it and extending in the outwards direction or in the opposite, inwards direction, and the other of the casing-parts having:

a central region opposite the depression in the other casing-part when the casing is closed and a rim around the central region, the rim extending inwards of the casing when closed or outwards, the directions in which the rims extend being such that when the casing is closed the rims fit the one within the other, and a super-absorbent material lining on at least one of the casing-parts, the lining extending from one or both of the depression and the central region as far as and between the rims to provide a super-absorbent lining that entirely lines the at least one of the casing parts when the casing is closed including entirely lining between the portion of the rims that fit the one within the other, with negligible clearance at the rims either between the linings where both casing-parts are lined or between the lining of the lined one of the casing-parts and the other casing-part where one only is lined, wherein super-absorbent material lining on at least one of the casing-parts the arrangement being such that liquid accidentally released from an encased container is absorbed by the super-absorbent material centrally of the rims and does not penetrate appreciably between the rims, initial liquid (if any) reaching the said negligible clearance and swelling the super-absorbent material there, with further permeation of liquid being blocked by the swelling providing "gel blocking".

2. A transport package as claimed in claim 1, wherein the central region is plain, with its casing-part acting as a lid to the other casing part.

3. A transport package as claimed in claim 1, wherein the central region has its own depression, with both casing-parts having respective container receiving depressions opposite each other for opposite portions of the same container.

4. A transport package as claimed in claim 3, wherein the respective depressions are of the same size.

5. A transport package as claimed in claim 3, wherein one of the respective depressions is larger than the other.

6. A transport package as claimed in claim 5, wherein the casing part having the larger depression has its rim extending in the same direction as the depression.

7. A transport package as claimed in claim 1, wherein a plurality of casing receiving depressions are provided for a plurality of containers.

8. A transport package as claimed in claim 7, wherein the depressions are sized to receive a plurality of different size of container.

9. A transport package as claimed in claim 1, wherein the or each depression has a regular shape and the rim in its casing-part extends directly from its edge.

10. A transport package as claimed in claim 9, further comprising a surround around the or each depression between the or each depression and the rim, wherein the surround and the central region, where only one casing-part has a depression, or the surrounds, where both casing-parts have depressions, have:

margins forming gel blocking corners with their rims, the margins abutting each other with negligible clearance, when the container is closed, and inner lands stepped away from each other, the arrangement allowing space for the super-absorbent lining to expand into in event of liquid release on container breaking, the margins providing pinch points at which gel blocking can occur against liquid permeation outwards of the margins.

11. A transport package as claimed in claim 1, wherein a surround is provided around the depression or the depressions in the respective casing-part between its depression(s) and its rim.

12. A transport package as claimed in claim 1, wherein the or each depression has at least one narrow region having prominent features arranged to locate the container within the depression and at least one wide region providing clearance from the container allowing space for the super-absorbent lining to expand into in event of liquid release on container breaking.

13. A transport package as claimed in claim 1, wherein the or each depression is sized to receive a container of a standard size and the package is sized to provide additional space within the closed package at least as large as the liquid contents space of the container(s), whereby the super-absorbent lining can absorb this volume of liquid.

14. A transport package as claimed in claim 13, wherein the additional space is at least half as large again as the liquid contents space.

15. A transport package as claimed in claim 1, wherein the package is provided with further features to ensure that it is leak-tight.

16. A transport package as claimed in claim 15, wherein:

the inner of the rims has a lip that turns out and has a return in the direction of the inner rim and the outer rim has a lip, sized to fit tightly between the inner rim and its return the rims and the lips form gel blocking corners.

17. A transport package as claimed in claim 16, wherein the return in the direction of the inner rim is angled towards the inner rim to overhang the edge of the other lip and captivate it.

18. A transport package as claimed in claim 1, wherein the two casing parts are separate.

19. A transport package as claimed in claim 1, wherein the two casing-parts are connected by a living hinge, forming a clam shell pair.

20. A transport package as claimed in claim 19, wherein the edges of the casing parts opposite from the living hinge are provided with a pair of inter-locking tabs.

21. A transport package as claimed in claim 1, wherein the lining is a mat of super-absorbent material and binding fibres.

22. A transport package as claimed in claim 1, wherein the lining has a surface layer of permeable material and with super-absorbent material captive between the surface permeable layer and the lined casing-part.

23. A transport package as claimed in claim 22, wherein the lining is comprised of two layers of non-woven fabric, having the super-absorbent material sandwiched between.

24. A transport package as claimed in claim 23, wherein the layers are loosely adhered together for cohesion of the lining.

25. A transport package as claimed in claim 22, wherein the lining is comprised of two layers of which one or other is of film, perforated in the case of the outer layer.

26. A transport package as claimed in claim 23, wherein the lining is provided with a coating of low melting point plastics material.

27. A transport package as claimed in claim 23, wherein the inner of the two layers is plastics material, such as polyethylene, having a lower melting point than that of the outer of the layers, such as polypropylene.

28. A transport package as claimed in claim 1, wherein a disinfectant, biocidal, antibacterial and/or antiviral agent is blended in with the super absorbent material.

29. A transport package as claimed in claim 1, wherein a colour change leak indicator is blended in with the super absorbent material.

30. A transport package as claimed in claim 1, including at least one envelope for a thermal controlling agent in contact with a respective casing-part for temperature control of the or each leak-risk container.

31. A transport package as claimed in claim 30, wherein the thermal controlling agent is a eutectic brine material.

32. A transport package as claimed in claim 30, wherein the or each phase change envelope includes a thermo-forming complementary to its casing-part and engaging it at its rim.

33. A transport package as claimed in claim 32, wherein the thermo-forming has a second thermo-forming welded to it to envelope the thermal controlling agent.

34. A transport package as claimed in claim 30, wherein the or each phase change envelope comprises a thermoforming having a lip welded to a complementary lip of the or each casing-part.

35. A transport package as claimed in claim 30, including a foam material receptacle for the casing and the eutectic material envelopes.

36. A method in the manufacture of a transport package as claimed in claim 1, including the steps of:

applying the lining material to casing part material in lamination rollers and subsequently thermoforming the casing-parts.

37. A method in the manufacture of a transport package as claimed in claim 1, including the steps of:

applying the lining material to casing part material in a thermoforming press and thermoforming the casing-parts and laminating the lining thereto in one operation.

38. A method in the manufacture of a transport package as claimed in claim 1, including the steps of:

injection moulding the casing-parts and subsequently applying the lining thereto.

39. A method in the manufacture of a transport package as claimed in claim 1, including the steps of:

placing lining material in an injection moulding tool and injection moulding the casing-parts against the lining material.

* * * * *